United States Patent [19]

Boyer et al.

[11] 4,310,752

[45] Jan. 12, 1982

[54] ELECTRONIC PRICE CONVERSION AND DISPLAY SYSTEM ADAPTED FOR INSTALLATION ON EXISTING MECHANICAL FLUID DISPENSING PUMPS

[75] Inventors: Pierre J. R. Boyer; Jacques J. F. Boyer, both of Pittsburg, Calif.

[73] Assignee: Boyer & Adcock, Pittsburg, Calif.

[21] Appl. No.: 80,168

[22] Filed: Sep. 28, 1979

[51] Int. Cl.[3] ..... G06M 1/27; B67D 5/22

[52] U.S. Cl. ..... 235/92 PL; 235/92 FL; 235/92 EA; 364/465

[58] Field of Search ..... 235/92 FL, 92 V, 92 FP, 235/92 EA, 92 PL, 94 A, 94 R; 222/23, 27; 364/465

[56] References Cited

U.S. PATENT DOCUMENTS

| | | | |
|---|---|---|---|
| 3,551,653 | 12/1970 | Yanagisawa et al. | 235/92 PL |
| 3,571,577 | 3/1971 | Kubo | 235/92 PL |
| 3,689,749 | 9/1972 | Johnston | 364/465 |
| 3,751,642 | 8/1973 | Todd et al. | 222/23 |
| 3,813,527 | 5/1974 | Langston | 235/92 FL |
| 3,818,192 | 6/1974 | Anderson et al. | 235/92 FL |
| 3,895,738 | 7/1975 | Buchanan et al. | 235/92 FL |
| 3,945,531 | 3/1976 | Clairmonte | 222/27 |
| 3,994,419 | 11/1976 | Sasnett et al. | 235/92 FL |
| 4,074,356 | 2/1978 | Schiller et al. | 235/92 FL |
| 4,100,400 | 7/1978 | Callahan et al. | 235/92 FL |
| 4,200,785 | 4/1980 | Evans | 235/92 FL |
| 4,212,068 | 7/1980 | Hoyt | 222/23 |

*Primary Examiner*—Joseph M. Thesz
*Attorney, Agent, or Firm*—Bruce & McCoy

[57] ABSTRACT

An electronic price conversion and display system adapted for installation on existing mechanical fluid dispensing pumps wherein sensors are mounted within the dispensing pump so as to be responsive to a plurality of angular position indicators disposed to rotate in fixed relation with the lowest order number display wheel of the pump's mechanical transaction price display. The number of indicators, preferably marks or slots placed directly on the lowest order number display wheel, are chosen in accordance with a desired price conversion. A display unit, which has a digital transaction price display and which is preferably placed on top of the pump for easy viewing, houses an electronic circuit which counts the passage of angular position indicators and increments the digital transaction price display to a reading corresponding to the indicator count. The digital transaction price display is made up of individual display digits and a logic circuit is provided in the display unit for suppressing the "O's" displayed by the higher order digiits until the higher order digits are needed to register price. The display of the display unit can be reset by a second sensor adapted to detect the transition of the pump motor current when the motor is switched on.

8 Claims, 11 Drawing Figures

ELECTRONIC PRICE CONVERSION AND DISPLAY SYSTEM ADAPTED FOR INSTALLATION ON EXISTING MECHANICAL FLUID DISPENSING PUMPS

FIELD AND BACKGROUND OF THE INVENTION

The present invention relates to fluid dispensing pumps generally, and more particularly to mechanical fluid dispensing pumps, and especially mechanical gasoline pumps, having mechanical display wheels to record their transaction price and which are limited in their unit volume price settings.

Most gasoline pumps in place throughout the United States and Canada are mechanical and are limited to a unit volume price setting of 99.9¢ per gallon, a unit volume price which in 1979 is quickly being exceeded. Once the price of gasoline exceeds the $99.9¢ per gallon figure, the station operator owning a conventional mechanical pump must set the pump's price setting to a per gallon figure which is some fractional value of the desired full per gallon price. It has become commonplace, for example, to quote gasoline prices in terms of a half gallon price. With this setting the operator multiplies the dollar amount appearing on the pumps mechanical transaction display by two (2) to determine the actual price of the transaction. The drawback to this practice is that it leads to confusion and error because of the need to make a mental conversion from the pump's displayed transaction price, which is tied to the pump's unit volume setting, to the actual transaction price. The practice has been criticized, however, the solution involves a major overhaul or replacement of the old pump which is expensive and economically prohibitive for many station owners. The need for fractional pricing could be eliminated for the present if the stations switched to liters, however, there is substantial resistance to such a change-over because of the familiarity with the English system of measure.

The present invention provides a relatively inexpensive solution to the limited display range problem of existing mechanical pumps by providing an electronic price conversion and display system which can be retrofitted to existing pumps without need for pump replacement or expensive pump modifications. The invention is adapted for easy installation on existing pumps and automatically takes the total transaction price mechanically displayed on the existing mechanical pump, multiplies it by a selected factor, such as two or three, and displays the result as a digital readout easily viewable by the pump operator and customer. The invention permits the pump operator to reduce his unit volume price setting on the pump to a fractional value of the actual unit volume price and have a total and accurate transaction price digitally displayed at the pump.

SUMMARY OF THE INVENTION

The present invention is an electronic price conversion and display system adapted to be installed on existing fluid dispensing pumps of the type having mechanical rotatable number display wheels, which range from a lowest order to a highest order number display wheel, for registering a total transaction price for fluid dispensed during a pumping cycle. The system comprises sensing means mounted within the fluid dispensing pump so as to be responsive to a plurality of angular position indicators disposed to rotate in fixed relation with the lowest order number display wheel of the pump's mechanical transaction price display, the number of such indicators being chosen in accordance with a desired price conversion. The wheel position sensing means generates electrical pulses corresponding in number to the passage of angular position indicators passing by the sensing means. A remote digital transaction price display is provided as is a circuit means for incrementing the price display with each pulse generated by the angular position indicator to provide a reading at the remote digital price display which correlates to the indicator count. Logic means for suppressing the higher order display digits of the digital price display prevent the dislay of a "0" in the higher order positions until the higher order positions are needed to register price. Further provided are means for resetting the digital price display after the completion of a pumping cycle.

OBJECTS OF THE INVENTION

It is therefore an object of the present invention to provide an electronic price conversion and display system which can be installed on existing mechanical fluid dispensing pumps, and particularly gasoline pumps, for extending the display capabilities of the pump.

It is another object of the present invention to provide an electronic price conversion and display system which can be easily and quickly installed on a pump with a minimum of pump modifications.

It is a further object of the present invention to provide an electronic price conversion and display system which is entirely electronic with no moving mechanical parts and which can be manufactured at minimum cost with relatively few parts.

It is still another object of the present invention to provide an electronic price conversion and display system which will operate in extreme environments.

It is still a further object of the present invention to provide an electronic price conversion and price display system which is energy efficient.

It is yet another object of the present invention to provide an electronic price conversion and display system which directly and accurately tracts the mechanical display of existing mechanical pumps.

Other objects of the invention will become apparent from the following specification and claims.

DETAILED DESCRIPTION OF THE PREFERRED EMBODIMENT

The present invention involves converting the mechanical transaction price display of conventional mechanical fluid dispensing pumps, particularly gasoline pumps, to a conveniently displayed digital readout which is a multiple of the mechanical readout at the dispensing pump. The invention provides a direct readout of the desired total transaction price when the pump has its unit volume price set at a fraction of the normal unit price value, e.g. price per ½ gallon. While the invention is primarily described below in terms of its use and installation on gasoline pumps, it is understood that the invention is not limited to gasoline pumps, but can as well be used on any fluid dispensing pump having a mechanical display.

Figure 1:
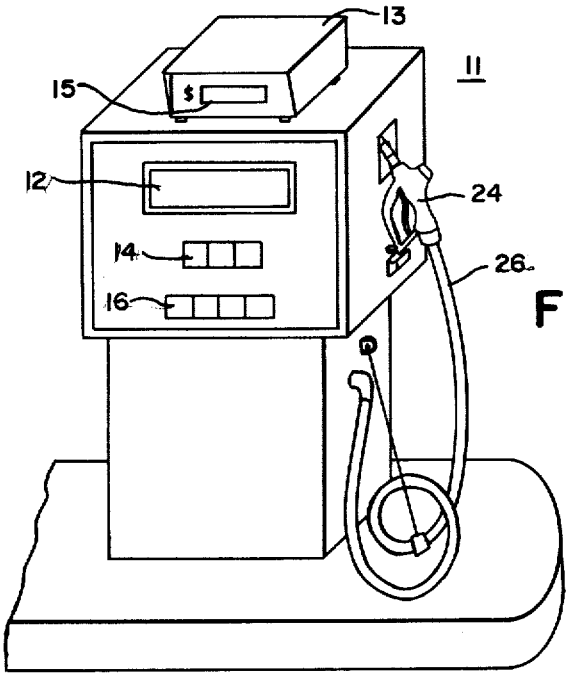
FIG. 1 is a perspective view of a conventional gasoline pump with the electronic price conversion and display system of the present invention installed thereon.
Figure 2:
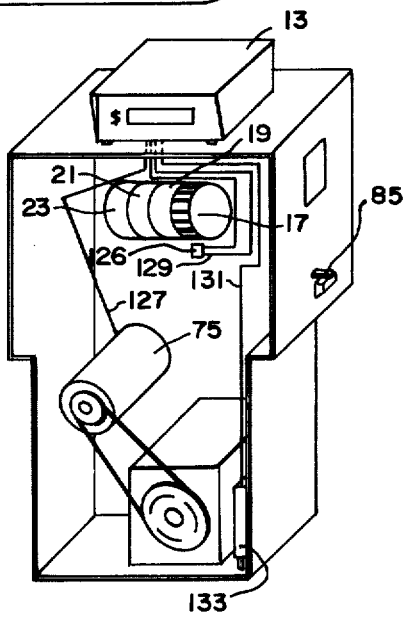
FIG. 2 is a pictorial view of the inside of the gasoline pump shown in FIG. 1, illustrating the internal wire connections of the display system of the present invention.

Referring now to the drawings, FIGS. 1 and 2 show the price display system of the present invention installed on a conventional gasoline pump 11, which has a mechanical transaction price display 12, a unit volume price display 14, which is preset, and a total dispensed volume display 16. As illustrated, the invention has a display unit 13 which provides a digital transaction price display 15 easily viewed by both the pump operator and customer. The display unit 13 houses most of the electronics of the overall system and, for easy viewing and installation, is shown as being installed on top of the pump 11. On certain types of mechanical pumps which have dome shape tops, it will be necessary to install the display unit elsewhere, such as on a suitable holding bracket attached to the side of the pump. Because the display unit 13 of the invention replaces the transaction price displayed at the pump, the pump's transaction price display 12 is preferably covered to prevent confusing the displays. The pump's unit volume price display 14 can also be covered to avoid confusing its settings, which is a fractional price, with the full and actual unit volume price separately posted, or which should be separately posted, on the pump.

Figure 6:
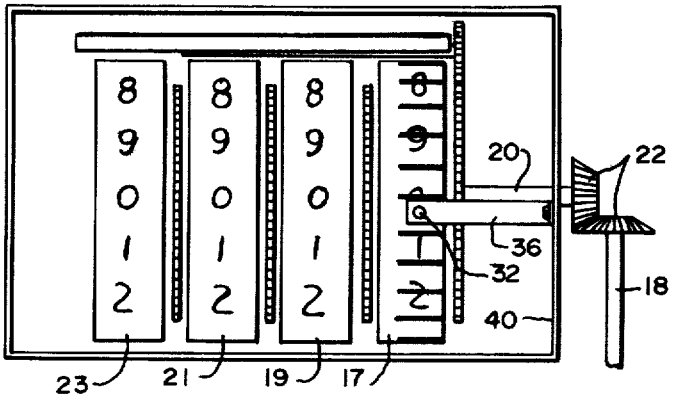
FIG. 6 is a pictorial view in front elevation of the pump's display wheels showing a slotted wheel and the general mounting arrangement of the display wheels and sensors within a pump.

As shown in FIGS. 2 and 6, the transaction total of a conventional mechanical pump is displayed by means of a plurality of rotatable number display wheels, 17, 19, 21, 23, arranged from a lowest order number display wheel 17 to a highest order number display wheel 23. It is usual to have four display wheels, with each display wheel having the numbers "0" to "9" uniformally spaced around its perimeter surface to register dollar price readings ranging from $00.01 to $99.99. The operation of the display wheels is best illustrated in FIG. 6. As the gas is pumped during a pumping cycle, the lowest order wheel 17 will be continually rotated through 1¢ increments by a drive shaft arrangement such as the shown right angle drive shafts 18, 20 coupled by bevel gears 22. As gas flows through the pump hose 24 and out nozzle 26 (FIG. 1) the display wheel 17 will rotate at a speed determined by the pump's unit volume price setting 14. Through a gearing arrangement, denoted generally by number 28, the lowest order display wheel 17 will advance the next lowest order wheel 19 (the tenths position) after each full revolution, which in turn will advance the next lowest order wheel 21 (the unit's position) after each full revolution, which will in turn similarly advance the tens position wheel 23.

Figure 4:
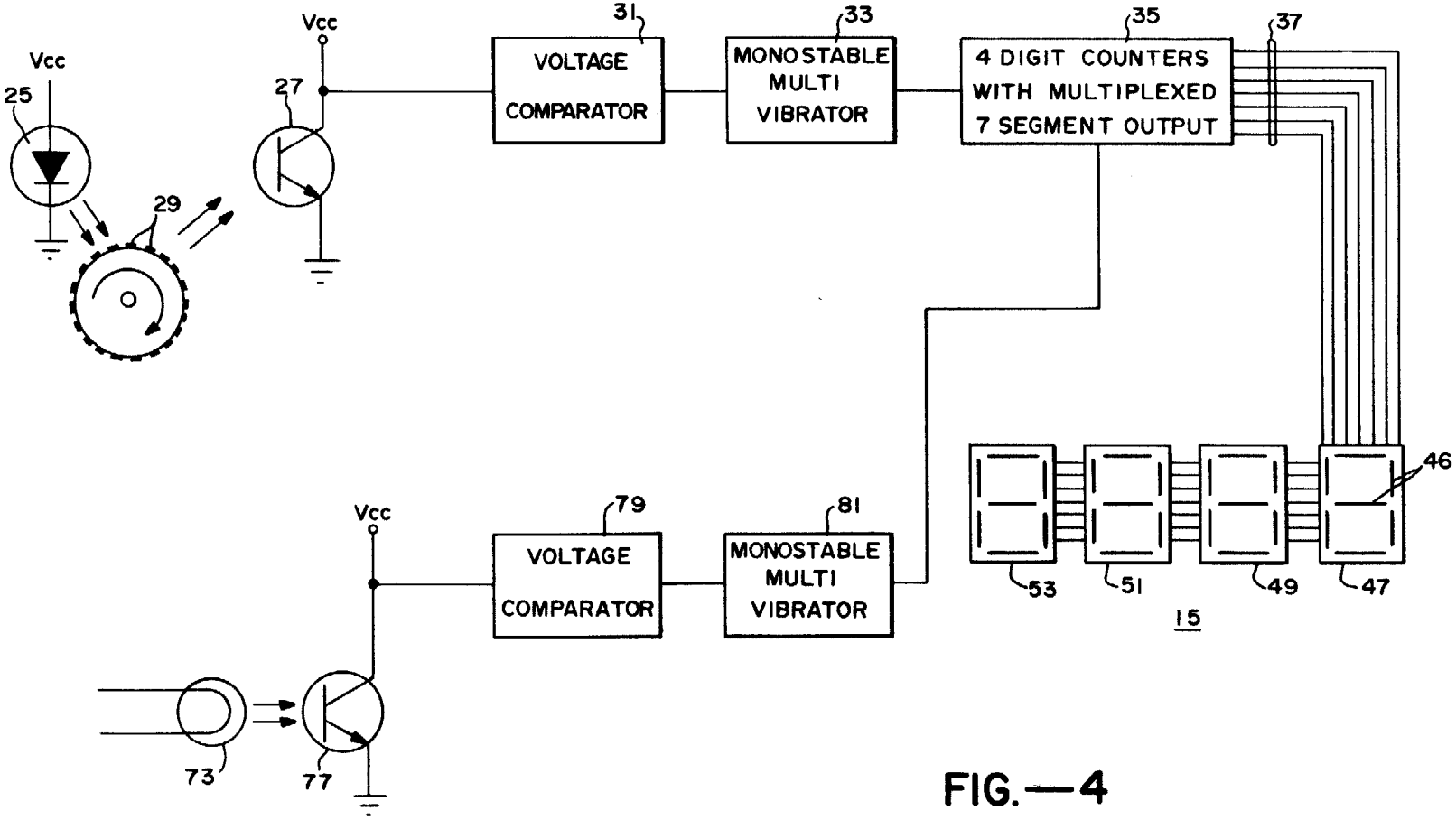
FIG. 4 is a combination pictorial and block diagram of a electronic price conversion and display system installed to count reflectors placed on the lowest order price display wheel of the mechanical pump.

Referring to FIG. 4, a plurality of angular position indicators in the form of reflective marks 29 are placed at substantially uniform intervals about the outer surface of the lowest order display wheel 17 or means comprised, in the illustrated embodiment, of a light source, such as light emitting diode (LED) 25, and a photodetection means, such as phototransistor 27 are placed in close proximity to the lowest order display wheel 17 such that the passage of reflective marks 29 by the sensor elements 25, 27 causes reflected light to be detected by the phototransistor 27. From the resulting pulses of reflected light the phototransistor produces electrical count pulses corresponding in number to the number of the reflective marks passing the sensor elements as the display wheel 17 rotates. As hereinafter described, the pulse count as derived from the passing reflectors is used to increment the digital transaction price display 15 of the separate display unit 13.

In accordance with the invention, the number of reflective markings placed on the display wheel 17 is chosen in accordance with the desired conversion factor for the digital transaction price display 15, with the conversion dictating the number of marks placed between each numerical digit imprinted on the wheel. For example, if a factor of two (2) is desired, whereby, for example, a mechanical readout at the pump's display 12 of $1 is digitally displayed as $2 at the digital display 15, two reflective markings would be placed on the circumference of the display wheel for each one cent increment. Thus, there would be a reflective marking at the one-half cent position, the one cent position, the one and one-half cent position, the two cent position, etc. If a factor of three is desired, three reflective markings would be used for each one cent increment.

Selection of the conversion factor for the digital transaction price readout is chosen prior to installation of the display system on the mechanical pump. The higher the factor, and thus the greater the number of marks 29 on the display wheel 17, the lower will be the mechanical unit price setting on the pump for any given full unit volume price. And the higher the factor the higher will be the pump's upper transaction price range. A factor of three (3) would likely to be the most desirable factor since it would not only permit the upper unit volume price range to be extended to $3 per gallon, but would also permit the pump operator to use the conventional format of expressing a full unit volume price, which is divisable by three (3), down to 9/10ths of a cent. For example, if a factor of three is used, and the desired unit volume price is about $1.20 per gallon, the mechanical setting on the pump could be set to 40 3/10¢ per gallon to produce the desired and fully converted transaction price at the digital display 15 based on a unit volume price of $1.20 9/10.

Figure 5:
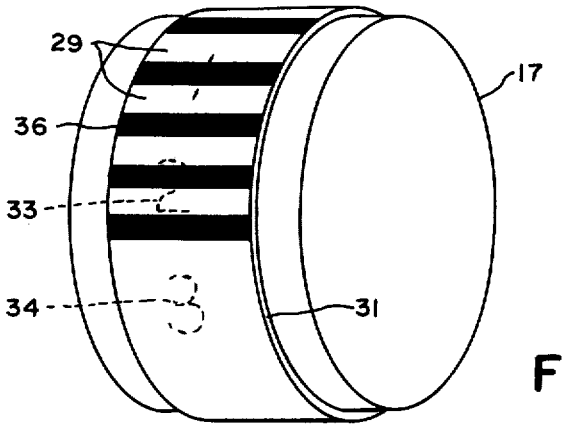
FIG. 5 is a perspective view of a price display wheel, such as shown in FIG. 4, utilizing single strip of reflective material with dark areas applied thereto.

As illustrated in FIG. 5, the reflective markings 29, also shown in FIGS. 2 and 4, are preferably placed on the display wheel 17 by wrapping the display wheel 17 with a reflective tape 31, such as a chrome-plated plastic material or stainless steel, and painting dark non-reflective areas 36 onto the tape. By choosing a reflective tape of suitable thickness a smooth surface can be provided over the relatively uneven display wheel surface which results from the number indentations (such as denoted 33 and 34) on the wheel. The tape 31 eliminates the adverse effects of an uneven surface on the operation of the LED and phototransistor pickup.

The width of the reflective marking 29 on the display wheel will depend on the choice of the prefocused LED and phototransistor and can readily be determined using commercially available parts. A commercially available infrared LED and phototransistor provided in a single module would be small enough so it can be mounted in a small bracket and adjusted through a small adjustment screw. An example of the bracket mounting is shown in FIGS. 6 and 7 and will hereinafter be described.

It is noted that, although the illustrated embodiment shows that the sensing of the angular position of the price display wheel is accomplished by detecting reflective markings suitably spaced about the circumference of the display wheel 17, it would be clear that other detectable markings could be used, and particularly magnetic markings used in conjunction with a suitable magnetic pick-up.

Figure 7:
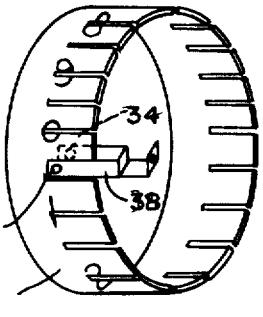
FIG. 7 is a perspective view of the slotted display wheel shown in FIG. 6 showing more clearly the mounting of the sensors relative to the slots.
Figure 8:
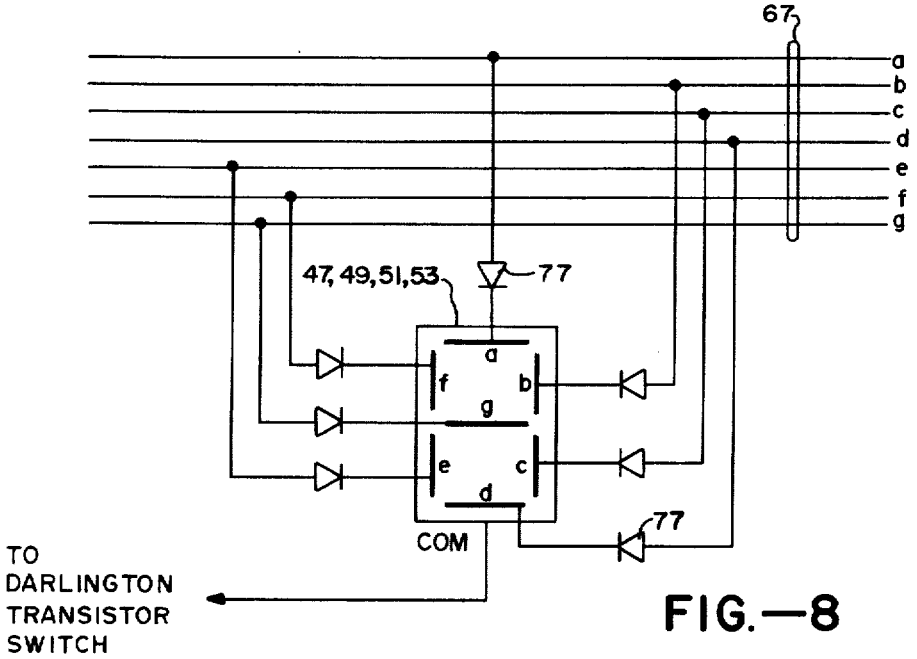
FIG. 8 is a schematic drawing illustrating the filament drive connections of the filament display tubes shown in FIGS. 4 and 9.

FIGS. 6 and 7 illustrate an alternative to placing markings on the display wheel 17 as above described. In the embodiment shown in FIGS. 6 and 7, slots 30 cut onto the edge of the wheel 17 serve instead as angular position indicators. The slots 30 are detected by an LED 32 and a photosensitive transistor 34 mounted in opposed relation on either side of the display wheel perimeter surface, such as by a bracket 38 suitably secured to the stationary support frame 40 surrounding the mechanical display wheels 17, 19, 21, 23. Utilizing slots instead of reflective markings has the advantage of providing a positive pickup which is not as subject to the effects of moisture of foreign matter which can collect in the pump; also, unlike the reflective sensor arrangement, slots will not require careful prefocusing of the sensor elements 32, 34. Moreover, installation would be somewhat facilitated by the slot indicators, in that, cutting slots in the display wheel 17 can be accomplished more easily than installing reflective tape.

As with positive markings, the number of slots would be chosen in accordance with the conversion desired at the transaction display 15 of the separate display unit 13. In the FIG. 6 illustration, there are two slots for each numerical digit, eighteen slots in all, to provide a conversion factor of $\times 2$ at the display.

It is noted that the slots might instead be openings of other shapes such as small holes spaced at uniform intervals about the display wheel. Also the angular position indicators, whether openings for positive pickup, or reflective or other marks, need not be placed directly on the display wheel 17, but could instead be placed on a separate wheel, disk, or the like, secured directly to the display wheel 17 or to a drive shaft, such as denoted 32 to rotate about an axis in fixed relation to the display wheel 17; the indicators might even be placed on the drive shaft itself, however, detection and proper positioning would become more difficult because of the small diameters involved. Regardless of the form and placement of the angular position indicators, the number of indicators would be chosen, as above described, based on the desired conversion factor for the invention's digital transaction display.

Figure 9:
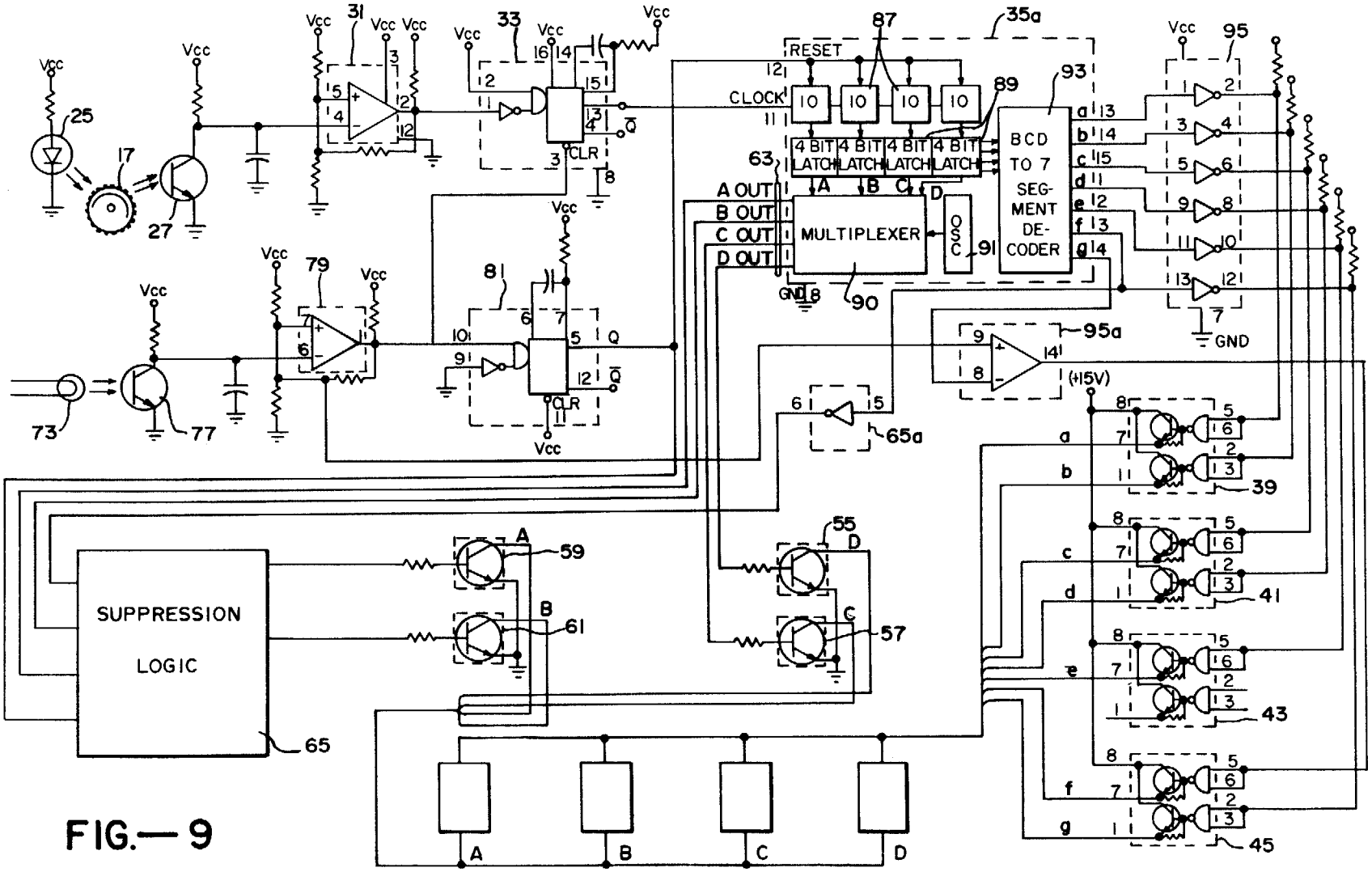
FIG. 9 is a detailed schematic drawing of the electronic conversion and price display system shown in FIG. 4.

Referring now to FIGS. 4 and 9, there is shown a circuit for incrementing the digital price display 15 by the electrical count pulses generated by the LED and phototransistor combination, 25, 27, or by other suitable sensing arrangements, such as shown in FIGS. 6 and 7. Generally the circuit is divided into a first circuit means which functions to count the phototransistor count pulses, and a second circuit means responsive to the output of the first circuit means for actuating the digital transaction price display 15. As shown in the illustrated embodiment, the first circuit means is comprised of a voltage comparator 31 which senses the voltage at the collector side of the phototransistor 27 and triggers the monostable multivibrator 33 (also known as a "one shot"). The thusly triggered one shot 33 provides a clock pulse to counter circuit 35 which has four (4) internal digital counters and a single multiplexed seven segment output 37. The second circuit means for actuating the digital price display is shown in the detailed schematic of FIG. 6 and, as shown, includes drivers 39, 41, 43, 45, for driving the tube filaments 46 of the digital display tubes 47, 49, 51, 53 (also identified in descending order as tubes A, B, C, and D) and sequencing circuitry for enabling the individual display tubes for multiplexed operation. Generally, the sequencing circuitry is comprised of Darlington switching transistors 55, 57, 59, 61, corresponding to the four display tubes A, B, C, and D. The Darlington transistors provide the switching for the tube enabling function, and are triggered by the tube enable sequenced outputs 63 from the internal multiplexer 90 of the counter ship 35*a*. Preferably, the switching of the Darlington transistors which enable the higher order display tubes, such as A and B, are suppressed by means of suppression logic 65 hereinafter described in more detail. The suppression logic functions to prevent the higher order tubes from being turned on, that is, from displaying a "zero", until the transaction price increases to the point where these tubes are utilized. In this manner energy consumption is minimized.

The parallel wiring of the filaments of the individual filament tubes from the output of the filament drivers 39, 41, 43, 45 is shown in FIG. 7. It is seen that each filament (identified by lower case letters a through f) of each of the seven segment filament display tubes 47, 49, 51, 53 is connected to the appropriate line of the segment drive lines 67 through a series diode 71. The diodes, it has been found, prevent crosstalk betweeen the individual display tubes as the tubes are sequenced through their respective ground circuits by the Darington transistor switches. Without the diodes, crosstalk between tubes will cause a largely meaningless and confused reading on the price display 15.

Referring again to FIGS. 4 and 9, a reset pulse for resetting the counter 35 at the end of a pumping cycle is preferably derived from a light source, such as a neon lamp 73, powered by a suitable actuating source within the pump, such as the pump motor 75 illustrated in FIG. 2, or an external switch (not shown). Starting of the pump motor will cause the lamp 73 to be illuminated, which in turn will cause the reset phototransistor 77 to become conductive, triggering a voltage comparator 79 which drives the one shot circuit 81: The output of the one shot 81 then defines the reset pulse. In a conventional pump design, the pump motor 75 will continue running until the power switch 85 on the side of the pump is turned off, at which time the pump motor will not again restart until the mechanical transaction price display of the mechanical display wheels 17, 19, 21, 23 has been reset to a zero position. Therefore, since an electrical reset pulse from the one shot 81 will only occur when the pump motor is initially actuated, the reset pulse will only and will always occur with the start of a new pumping cycle. It is noted that the pump motor would not be used as a source of the reset pulse if one motor is used to drive more than one gasoline pump, as is sometimes the case.

Referring again to the detailed schematic of FIG. 9, it can be seen that multiplexing the count information to the four display tubes 47, 49, 51, 53 permits the display tubes to be driven by a circuit made up of a minimum number of microelectric circuits, known as "chips". The circuit shown includes a single chip 35*a* containing four 4-bit counters 87, each with a BCD output connected to a 4-bit latch 89, with the output of the latches being multiplexed to a BCD to seven segment output decoder 93 having an output line corresponding to each of the seven segments, a through f, of the filaments of the display tubes A, B, C, and D. The sampling rate for the multiplexed output is determined by an internal oscillator 91 and is typically 1000 samples per second. Further required circuit elements commercially available on separate chips include an inverter circuit 95 for the seven segment output of chip 35*a*, and the four driver pairs 39, 41, 43, 45 for providing a 15 volt multiplexed filament drive signal for each filament segment. The multiplexing feature reduces the required electronics in that, without multiplexing, twenty eight (28) drivers would likely be required (seven for each display tube), together with four (4) BCD decoders, and four (4) cascading counters with BCD outputs. Commercially available microelectric chips for implementing the circuit of FIG. 6 include the following:

| FIG. 9 REF. NOS. | MANUFACTURER | MANUFACTURER'S PART NO. | DESCRIPTION |
|---|---|---|---|
| 35a | National Semi-Conductor | MM74C925 | 4 digit counters with multiplexed 7 segment output drivers |
| 39, 41 43, 45 | National Semi-Conductor | MM74C908 | Dual CMOS 30 volt driver |
| 95 | Texas Instruments | SN5406 | Hex Inverter Buffer/driver with open collector eye voltage outputs |
| 31, 79, 95a | National Semi-Conductor | MM74C909 | Quad Comparator |
| 33, 81 | National Semi-Conductor | MM746221 | Dual Monostable multivibrator |
| 65a | National Semi-conductor | CD4069L | Hex Inverter |

The above listing of chips is intended to be illustrative, and it is understood that other suitable commercially available microelectric parts be used. For convenience pin numbers corresponding to the above listed chips are shown in FIG. 9.

Figures 10, 11:
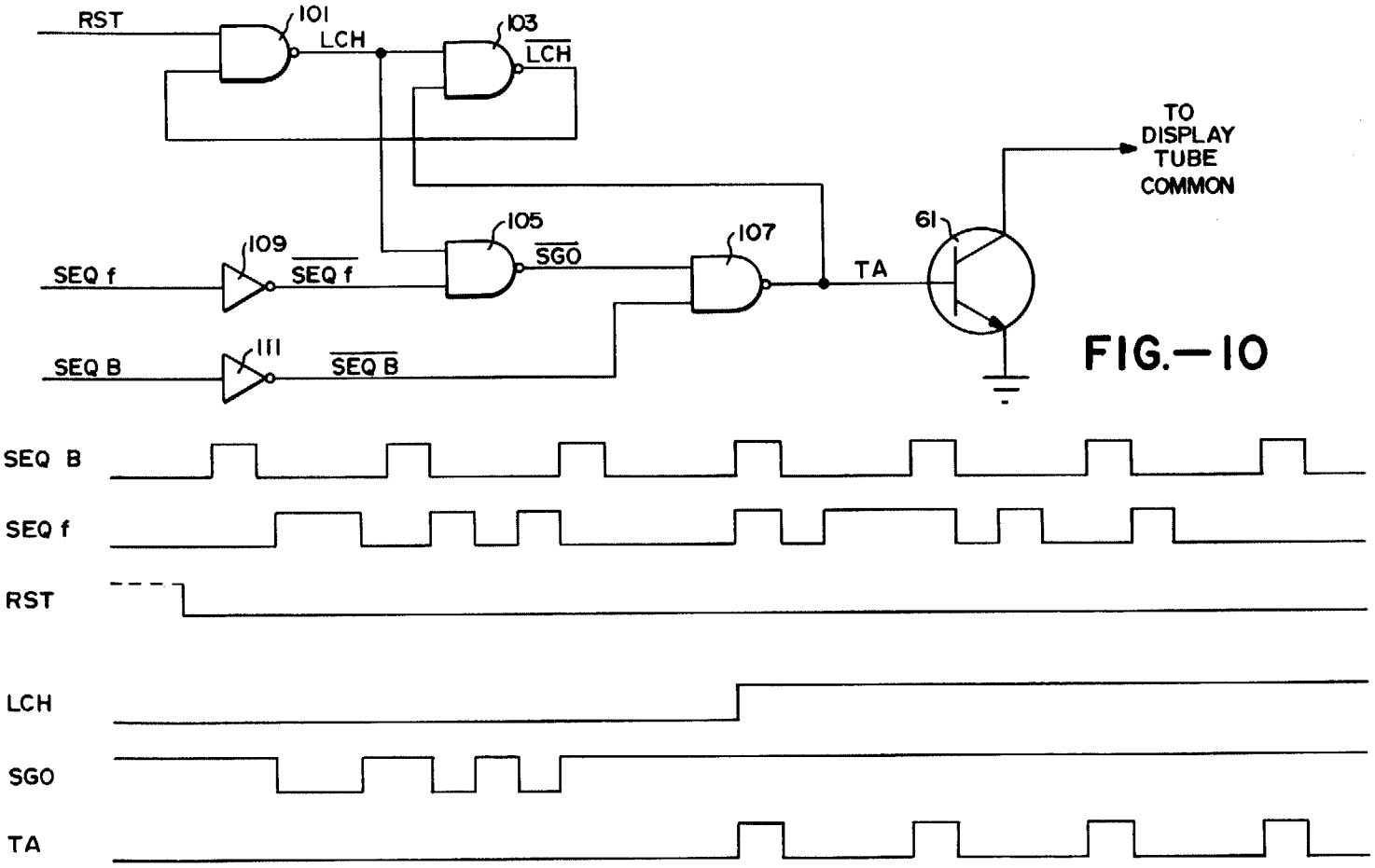
FIG. 10 is a schematic diagram of the suppression logic shown in FIG. 9.
FIG. 11 is a representation of the logic pulses for the suppression logic shown in FIG. 10.

Referring now to FIG. 10, the suppression logic, shown in block diagram form in FIG. 9, is comprised of NOR gates 101, 103, 105, 107 and input inverters 109, 111; there is a logic circuit for each of the tube allow Darlington transistors 59, 61, corresponding to display tubes A and B. In describing the logic circuit, reference shall be made to the suppression logic for display tube B, it being understood that the suppression logic for display tube A is identical, except that with an input from sequencing output A of the multiplexer 90 is used instead of an input from sequencing output B.

With respect to the suppression logic for tube B, the logic inputs are the reset pulse, segment "f" of the filament drive for the display tubes, and the B sequencing output from the multiplexer 90 of the counting circuit 35*a*. The suppression logic achieves two logic condition which are described as follows: A latch condition is set by the reset pulse wherein the latch (LCH) suppresses the strobe signal (SGO) outputted from nor gate 105 which suppresses the tube allow pulse TA normally strobed by the sequence B input (SEQ B) to the tube enabling Darlington transistor 61. An "on" condition is provided when the latch is removed which occurs when the f segment (SEQ f) pulse coincides with a sequencing pulse SEQ B. Once turned "on" by this coincidence of pulses, the latch remains removed whereupon a tube allow pulse TA will coincide with the train of the tube B sequencing pulses (SEQ B). The logic of the suppression logic can be described by the following boolean expressions:

$$LCH = TA \cdot \overline{RST}$$

$$TA = SEQ\ B \cdot SGO$$

$$SGO = LCH + \overline{SEQ\ f}$$

$$TA = SEQB \cdot (LCH + \overline{SEQ\ f})$$

The timing diagram of FIG. 11 illustrates this logic and shows the tube allow output TA of nor gate 107 being turned on by the concurrence of the f filament segment pulse SEQ f and the sequence pulse SEQ B.

Figure 3:
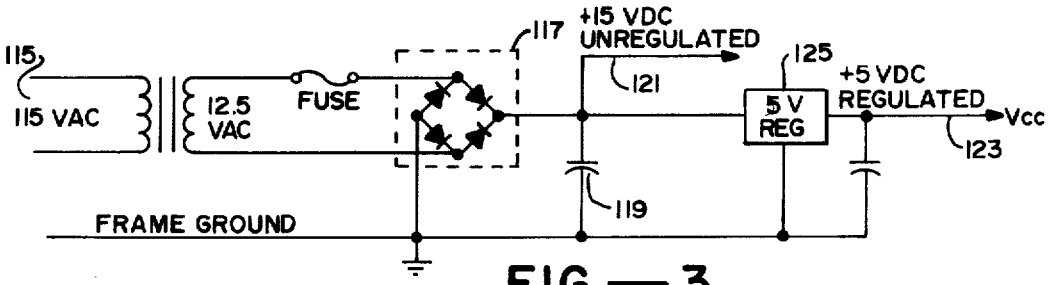
FIG. 3 is a schematic view of the power supply circuit for the display unit of the present invention.

To operate, the microelectric circuit shown in detail in FIG. 9 requires a regulated 5 volts DC and 15 volts DC unregulated. These voltages can be provided by the power supply circuit illustrated in FIG. 3, which takes power from the 115 volt AC power input used to drive the pump. The 115 volts AC is transformer coupled to a bridge rectifier 117 and filter capacitor 119 to provide 15 volts DC unregulated 121, from which a regulated 5 volts DC 123 is obtained through a voltage regulator 125. It is noted that since the laws of many states may require that 115 volt wiring be placed in conduit, it may be desirable, from the point of view of reducing installation costs, to provide a power supply separate from the display unit whereby all new wiring in the pump will carry low DC voltages.

It should be noted that the invention as implemented in the illustrated embodiments described herein calls for a separate and distinct display unit 13 housing the principal electronics of the device. However, it is understood that the electronics need not be housed in a single unit, and in fact, could consist of separate display external to the pump which is driven by an electronic package or packages which are mounted internally of the pump.

To install the price conversion and display system of the present invention on a conventional gasoline pump, such as shown in FIG. 2, a small wire receiving hole (not shown) can be drilled in the top of the pump underneath where the display unit is placed. The three wires 127, 129, 131, which extend from the bottom of the display unit 13 are then inserted through this receiving hole and wired, respectively, into the pump motor 75 (assuming the pump reset is actuated by motor current) to the sensors 126 and to the pump's 115 volt power box 133. The lowest order display wheel 17 is then modified, as above described, to place angular position indicators thereon, with the number of indicators used being chosen in accordance with the desired conversion factor for the transaction price displayed at the digital price display 15. Finally the sensors 126 are mounted within the pump so that they can detect the indicators on the wheel. With the display system of the present invention thusly installed and operational, the operator of the pump will set the unit volume price setting of the pump to the appropriate fractional value of the full unit volume price. The operator then operates the pump in the normal fashion, with the full transaction price being read on the digital price display 15 of the present invention, rather than the mechanical readouts of the pump, which are preferably covered except for the dispensed volume readout. Each time a pumping cycle commences the digital display will be automatically reset to zero.

Therefore, it can be seen that the present invention is an electronic price conversion and display system which is readily adapted for installation on existing mechanical fluid dispensing pumps and which derives a converted price by counting a preselected number of angular position indicators disposed to rotate in a fixed relation with the pump's lowest order transaction price display wheel. With the system installed the pump operates on a unit volume price setting which is a fractional value of the actual full unit volume price for the transaction. Although the invention has been described in considerable detail in the foregoing description of the preferred embodiment it is not intended that it be limited to such detail, except as necessitated by the appended claims.

What we claim is:

1. In a mechanical fluid dispensing pump having rotatable number display wheels ranging from a lowest order to a highest order number display wheel, wherein said number display wheels register a total price for fluid dispensed during a pumping cycle, a remote electronic price conversion and display system comprising angular position indicators placed around said lowest order number display wheel at preselected intervals, means mounted within said pump for sensing the passage of said angular position indicators as said indicators are rotated, the response of said sensing means being to generate count pulses corresponding to passage angular position indicators, first circuit means for providing count information derived from the electrical pulses generated by said photodetection means, said first circuit means having a multiplexed multi-segment output for transmitting count information, a remote digital price display comprised of individual multi-segment display digits ranging from a lowest order to a highest order display digit, second circuit means for actuating each multi-segment display digit of said remote price display from the multiplexed multi-segement output of said first circuit means to provide a digital transaction price readout at said remote price display which correlates with the total number of count pulses generated by said angular position indicators as they rotate past said sensing means, whereby the number, and hence the spacing, of said angular position indicators in relation to the spacing of the numbers imprinted on said lowest order display wheel will determine the conversion between the transaction price as displayed on the pump's mechanical display wheels and the transaction price as displayed on said remote digital display, said second circuit means including a sequencing circuit for sequencing the multiplexed output of said first circuit means to said individual display digits of said digital price display, said sequencing circuit having logic means for suppressing the multiplexed output from said first circuit means which is sequenced to the higher order display digits of the price display when said higher order digits read "0" whereby said display digits are not actuated until the price indication reaches a level which utilizes such higher order digits, and means for resetting said remote price display after the completion of a pumping cycle.

2. The electronic price conversion and display system of claim 1 wherein said angular position indicators on said lowest order number display wheel are reflective markings, and wherein said sensing means includes a light source and photodetection means mounted within said fluid dispensing pump proximate its lowest order display wheel such that the photodetection means is responsive to light from said light source which is reflected from the reflective markings on said display wheel.

3. The electronic price conversion and display system of claim 2 wherein said reflective markings are formed by at least one strip of reflective material wrapped around said display wheel with non-reflective areas placed thereon to separate reflective areas.

4. The electronic price conversion and display system of claim 1 wherein said angular position indicators on said lowest order number display wheel are openings in said display wheel, and wherein said sensing means includes a light source and photodetection means mounted in opposed relation within said fluid dispensing pump to be responsive to the passage of said display wheel openings therebetween.

5. The electronic price conversion and display system of claim 4 wherein said openings are slots cut into the side of said lowest order display wheel.

6. The remote electronic price display system of claim 1 wherein said means for resetting said price display includes means for generating a reset pulse in response to a detectable actuating force within said fluid dispensing pump.

7. The remote electronic price display system of claim 6 wherein said fluid dispensing is driven by an electric pump motor and wherein said reset pulse generating means includes a reset light source connected in series with said pump motor whereby when the motor is activated at the start of a pump cycle said second light source will be illuminated, a reset photodetection means for detecting the illumination of said reset light source, a one shot circuit interconnected to said reset photodetection means so as to be triggered thereby upon illumination of said reset light source whereby a pulse useful as a reset pulse is outputted by said one shot circuit upon the start of the pump motor at the start of a pumping cycle.

8. The remote electronic price display system of claim 7 wherein said reset light source is a neon lamp.

* * * * *